US011104544B2

(12) United States Patent
Wurth et al.

(10) Patent No.: US 11,104,544 B2
(45) Date of Patent: Aug. 31, 2021

(54) ELEVATOR COUNTERWEIGHT SIGNALING SYSTEM

(71) Applicant: Wurtec, Incorporated, Toledo, OH (US)

(72) Inventors: Steven P. Wurth, Sylvania, OH (US); Douglas Scott, Grosse Ile, MI (US); Terry Rodebaugh, Whitehouse, OH (US); Mike Churski, Lambertville, MI (US)

( * ) Notice: Subject to any disclaimer, the term of this patent is extended or adjusted under 35 U.S.C. 154(b) by 745 days.

(21) Appl. No.: 15/735,220

(22) PCT Filed: Jun. 29, 2016

(86) PCT No.: PCT/US2016/039992
§ 371 (c)(1),
(2) Date: Dec. 11, 2017

(87) PCT Pub. No.: WO2017/019236
PCT Pub. Date: Feb. 2, 2017

(65) Prior Publication Data

US 2018/0179020 A1 Jun. 28, 2018

Related U.S. Application Data

(60) Provisional application No. 62/197,139, filed on Jul. 27, 2015.

(51) Int. Cl.
*B66B 5/00* (2006.01)
*B66B 3/02* (2006.01)
(Continued)

(52) U.S. Cl.
CPC ..... *B66B 5/0018* (2013.01); *B66B 3/002* (2013.01); *B66B 5/005* (2013.01); *B66B 5/02* (2013.01); *B66B 7/00* (2013.01)

(58) Field of Classification Search
CPC ... B66B 5/0018; B66B 5/0037; B66B 1/3492; B66B 3/023
(Continued)

(56) References Cited

U.S. PATENT DOCUMENTS 3,791,490 A * 2/1974 Smith ..... B66B 5/022 187/278
6,296,080 B1 * 10/2001 Draper ..... B66B 5/04 187/373
(Continued)

FOREIGN PATENT DOCUMENTS

CN 203173628 U 9/2013
CN 206447435 U 8/2017
(Continued)

*Primary Examiner* — Christopher Uhlir
(74) *Attorney, Agent, or Firm* — Charles F. Charpie, III; Eastman & Smith Ltd.

(57) ABSTRACT

An elevator counterweight signaling system is provided. The elevator counterweight signaling system includes an actuation assembly configured for contact with an elevator counterweight guide rail. A signaling assembly is configured for electrical communication with the actuation assembly and one or more electrical connectors is configured to electrically connect the actuation assembly with the signaling assembly. The signaling assembly is configured to provide visual and/or audio indications of a moving elevator counterweight assembly.

20 Claims, 7 Drawing Sheets

(51) Int. Cl.
*B66B 3/00* (2006.01)
*B66B 5/02* (2006.01)
*B66B 7/00* (2006.01)

(58) Field of Classification Search
USPC ..... 187/390
See application file for complete search history.

(56) References Cited

U.S. PATENT DOCUMENTS

| | | | | |
|---|---|---|---|---|
| 6,494,296 | B2 | 12/2002 | Lindegger et al. | |
| 10,329,117 | B2 * | 6/2019 | Ye | B66B 9/00 |
| 2001/0035828 | A1 | 11/2001 | Rossignol | |
| 2012/0152659 | A1 * | 6/2012 | Husmann | B66B 5/0087 187/373 |
| 2015/0158698 | A1 * | 6/2015 | Moser | B66B 1/3492 187/266 |

FOREIGN PATENT DOCUMENTS

| | | | |
|---|---|---|---|
| JP | H06239551 | A | 8/1994 |
| JP | H07237839 | A | 9/1995 |
| JP | H11199151 | A | 7/1999 |
| JP | 2000072349 | A | 3/2000 |
| JP | 2007284239 | A | 11/2007 |
| JP | 2008056411 | A | 3/2008 |
| JP | 2010195530 | A | 9/2010 |
| JP | 2015081193 | A | 4/2015 |
| JP | 2015155338 | A | 8/2015 |
| JP | 2016128350 | A | 7/2016 |

* cited by examiner

| Fault Conditions | Fault Operation |
|---|---|
| 1. Signaling Assembly (54) in "On" mode, Internal Power Source (118) providing power to Signaling Assembly (54), Electrical Connector (56) disconnected. | Audio and visual signals remain activated with or without car movement. |
| 2. Dynamo Assembly (90) providing power through movement of elevator car (12), no tachometer signal from Tachometer Assembly (104). | Audio and visual signals remain activated with or without car movement. |
| 3. Tachometer Assembly (104) signal detected, no power provided by Dynamo Assembly (90). | Audio and visual signals remain activated with or without car movement. |
| 4. Low power from Internal Power Source (118), no detected car motion. | Audio signal for low power. |

130 134 138 142

132 136 140 144

FIG. 9

ELEVATOR COUNTERWEIGHT SIGNALING SYSTEM

RELATED APPLICATIONS

This application claims priority from U.S. Provisional Patent Application No. 62/197,139, filed Jul. 27, 2015, the disclosure of which is incorporated herein by reference in its entirety.

BACKGROUND

An elevator is a type of vertical transportation equipment that efficiently moves people and/or goods between floors, levels and/or decks of a building, vessel or other structure. One type of elevator is called a traction elevator. Traction elevators use geared or gearless traction machines to drive suspension elements connected on one end to an elevator car and connected on the opposite end to a counterweight. The elevator car and the counterweight are located within a portion of the building referred to as a hoistway. The geared or gearless machines are driven by electric motors.

Typically, the elevator car moves in a vertical direction within opposing car guide rails and the counterweight move in an opposing vertical direction within opposing counterweight guide rails. Often, the placement of the car and counterweight guide rails are such that the elevator car and the counterweight can be in close proximity to each other.

In operation, as the elevator car and the counterweight move in opposite directions within the hoistway, at an approximate midpoint of the hoistway, the elevator car and the counterweight are positioned substantially adjacent to each other, albeit traveling in different vertical directions. In the event personnel are positioned atop the elevator car, those personnel can become startled as the elevator car and the counterweight cross in close proximity to each other and in opposite vertical directions.

It would be advantageous if elevators could be made safer.

SUMMARY

The above objects as well as other objects not specifically enumerated are achieved by an elevator counterweight signaling system. The elevator counterweight signaling system includes an actuation assembly configured for contact with an elevator counterweight guide rail. A signaling assembly is configured for electrical communication with the actuation assembly and one or more electrical connectors is configured to electrically connect the actuation assembly with the signaling assembly. The signaling assembly is configured to provide visual and/or audio indications of a moving elevator counterweight assembly.

Various objects and advantages of the elevator counterweight signaling system will become apparent to those skilled in the art from the following detailed description, when read in light of the accompanying drawings.

BRIEF DESCRIPTION OF THE DRAWINGS

FIG. 9 is a table illustrating fault conditions and fault operations of the counterweight signaling system of FIG. 4.

DETAILED DESCRIPTION OF THE INVENTION

The elevator counterweight signaling system will now be described with occasional reference to specific embodiments. The elevator counterweight signaling system may, however, be embodied in different forms and should not be construed as limited to the embodiments set forth herein. Rather, these embodiments are provided so that this disclosure will be thorough and complete, and will fully convey the scope of the elevator counterweight signaling system to those skilled in the art.

Unless otherwise defined, all technical and scientific terms used herein have the same meaning as commonly understood by one of ordinary skill in the art to which the elevator counterweight signaling system belongs. The terminology used in the description of the elevator counterweight signaling system herein is for describing particular embodiments only and is not intended to be limiting. As used in the description of the elevator counterweight signaling system and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the elevator counterweight signaling system. Notwithstanding that the numerical ranges and parameters setting forth the broad scope of the elevator counterweight signaling system are approximations, the numerical values set forth in the specific examples are reported as precisely as possible. Any numerical values, however, inherently contain certain errors necessarily resulting from error found in their respective measurements.

In accordance with embodiments of the present invention, an elevator counterweight signaling system is provided. Generally, the elevator counterweight signaling system is configured to provide visual and/or audio indications of a moving elevator counterweight. The term "counterweight", as used herein, is defined to mean any structure configured to balance a portion of the weight of the elevator car and rated capacity of the elevator car. It will be understood the term "guide rail", as used herein, is defined to mean any structure forming a track for guiding an elevator car or counterweight.

Figure 1:
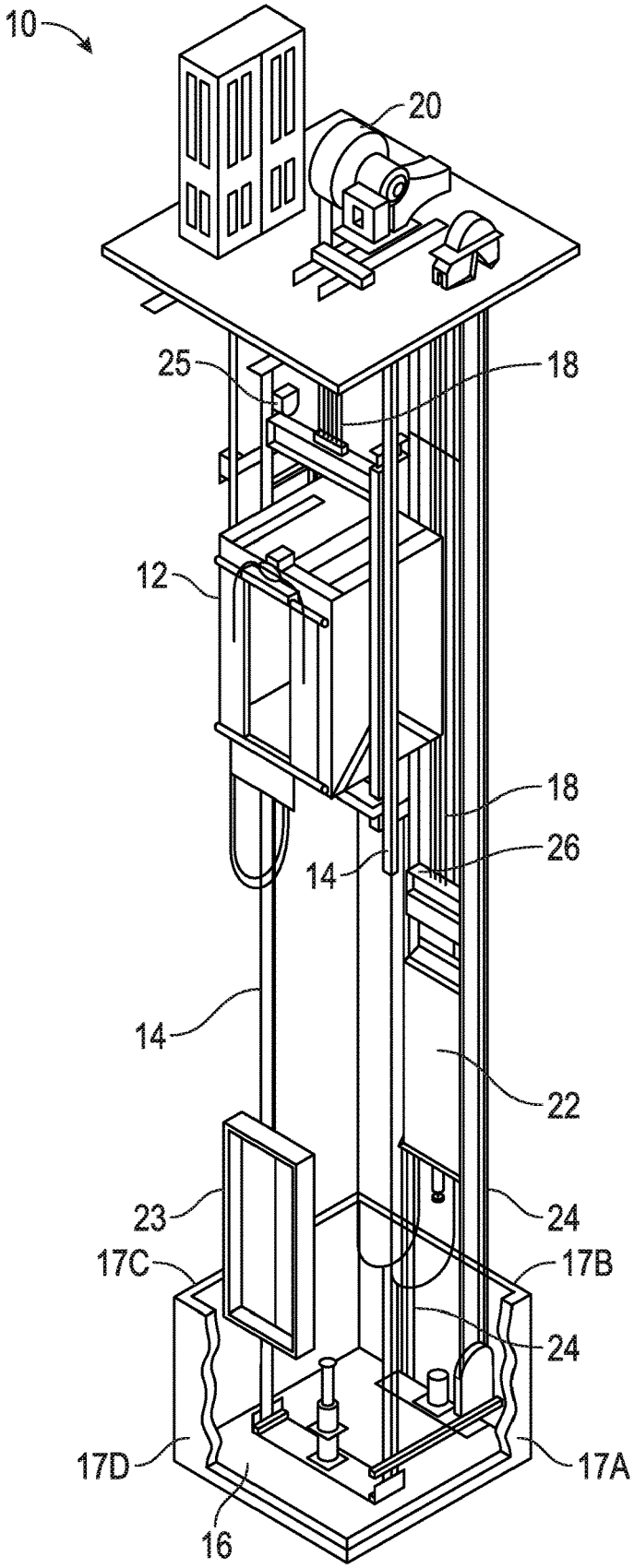
FIG. 1 is a perspective view of a conventional elevator.

Referring now to the drawings, there is illustrated in FIG. 1 a diagrammatic and simplified view of an elevator 10. The elevator 10 is conventional in the art and will only be briefly described herein. The elevator 10 includes an elevator car 12, moving in a substantially vertical direction on opposing car guide rails 14. The opposing car guide rails 14 are disposed in the elevator hoistway 16. In the illustrated embodiment, the hoistway 16 is defined by cooperating hoistway walls 17A-17D. However, it should be appreciated that in other embodiments, the hoistway 16 can be defined by other structures, assemblies and components, such as the non-limiting example of structural divider beams and the like. The elevator car 12 is supported at one end of one or more suspension ropes 18, which are moved with an elevator machine 20. The other end of the one or more suspension ropes 18 is connected to a counterweight assembly 22. The counterweight assembly 22 is configured to balance a portion of the weight of the elevator car 12 and the rated capacity of the elevator car 12. The counterweight assembly 22 moves in a substantially vertical direction on opposing counterweight guide rails 24.

The elevator car 12 includes a plurality of car guide members 25 configured to roll or slide against the car guide rails 14 as the elevator car 12 moves vertically within the hoistway 16. In a similar manner, the counterweight assembly 22 includes a plurality of counterweight guide members 26 configured to roll or slide against the counterweight guide rails 24 as the counterweight assembly 22 moves vertically within the counterweight guide rails 24.

Referring again to FIG. 1, the hoistway 16 is divided vertically into building floors (not shown). The building floors can have entrances 23 configured to facilitate ingress into and egress out of the elevator car 12.

Figure 2:
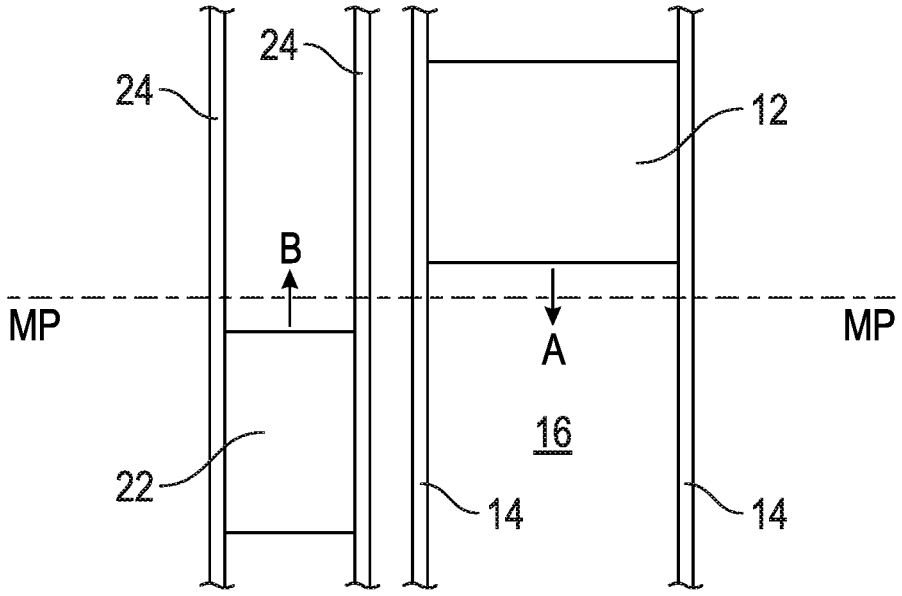
FIG. 2 is a simplified, schematic front view in elevation, of a portion of a conventional elevator hoistway of FIG. 1, showing the elevator car and the counterweight in relative first positions in the elevator hoistway.

Referring now to FIG. 2, a simplified illustration of the elevator hoistway 16 of FIG. 1 is shown. The elevator car 12 is supported by the opposing elevator guide rails 14 and the counterweight assembly 22 is supported by the opposing counterweight guide rails 24. With the elevator car 12 positioned at an upper location within the hoistway 16, the counterweight assembly 22 is correspondingly positioned in a lower location within the hoistway 16. As the elevator car 12 descends to lower levels of the hoistway 16, as shown by direction arrow A, the counterweight assembly 22 travels in the opposite vertical direction, thereby ascending as shown by direction arrow B. At an approximate midpoint of the hoistway 16 as shown schematically by axis MP-MP, the elevator car 12 and the counterweight assembly 22 are positioned substantially adjacent to each other, albeit traveling in different vertical directions. In the event personnel are positioned atop the elevator car 12, those personnel can become startled as the elevator car 12 and the counterweight assembly 22 cross in close proximity to each other while traveling in opposite vertical directions.

Figure 3:
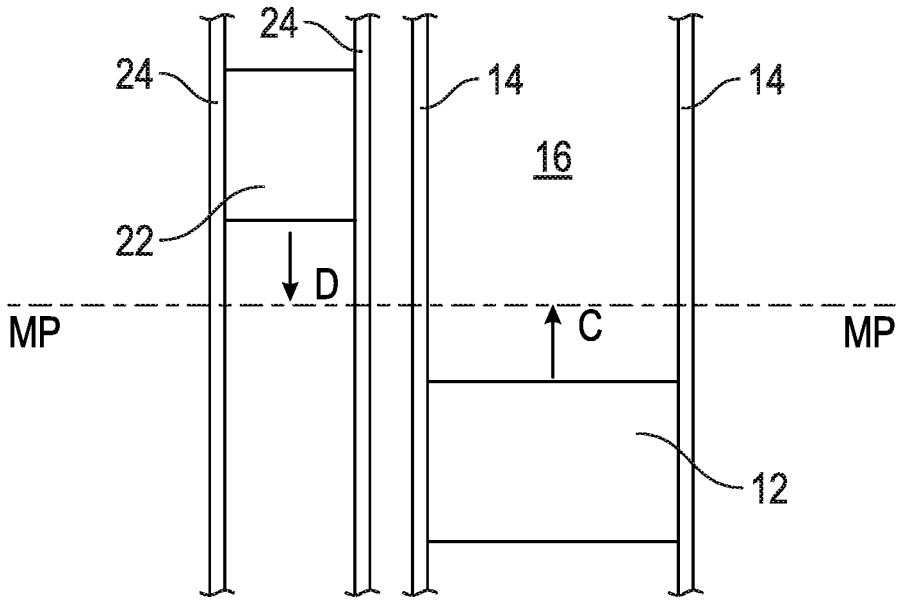
FIG. 3 is a simplified, schematic front view in elevation, of a portion of a conventional elevator hoistway of FIG. 1, showing the elevator car and the counterweight in relative second positions in the elevator hoistway.

Referring now to FIG. 3, the elevator car 12, again supported by the opposing car guide rails 14, is positioned at a lower location within the hoistway 16 and the counterweight assembly 22, supported by the counterweight guide rails 24, is correspondingly positioned in an upper location within the hoistway 16. As the elevator car 12 ascends to upper levels of the hoistway 16, as shown by direction arrow C, the counterweight assembly 22 travels in the opposite vertical direction, thereby descending as shown by direction arrow D. As before, at an approximate midpoint of the hoistway 16 as shown schematically by axis MP-MP, the elevator car 12 and the counterweight assembly 22 are positioned adjacent to each other, albeit traveling in different vertical directions. In the event personnel are positioned atop the elevator car 12, those personnel can become startled as the elevator car 12 and the counterweight assembly 22 cross in close proximity to each other while traveling in opposite vertical directions.

Figure 4:
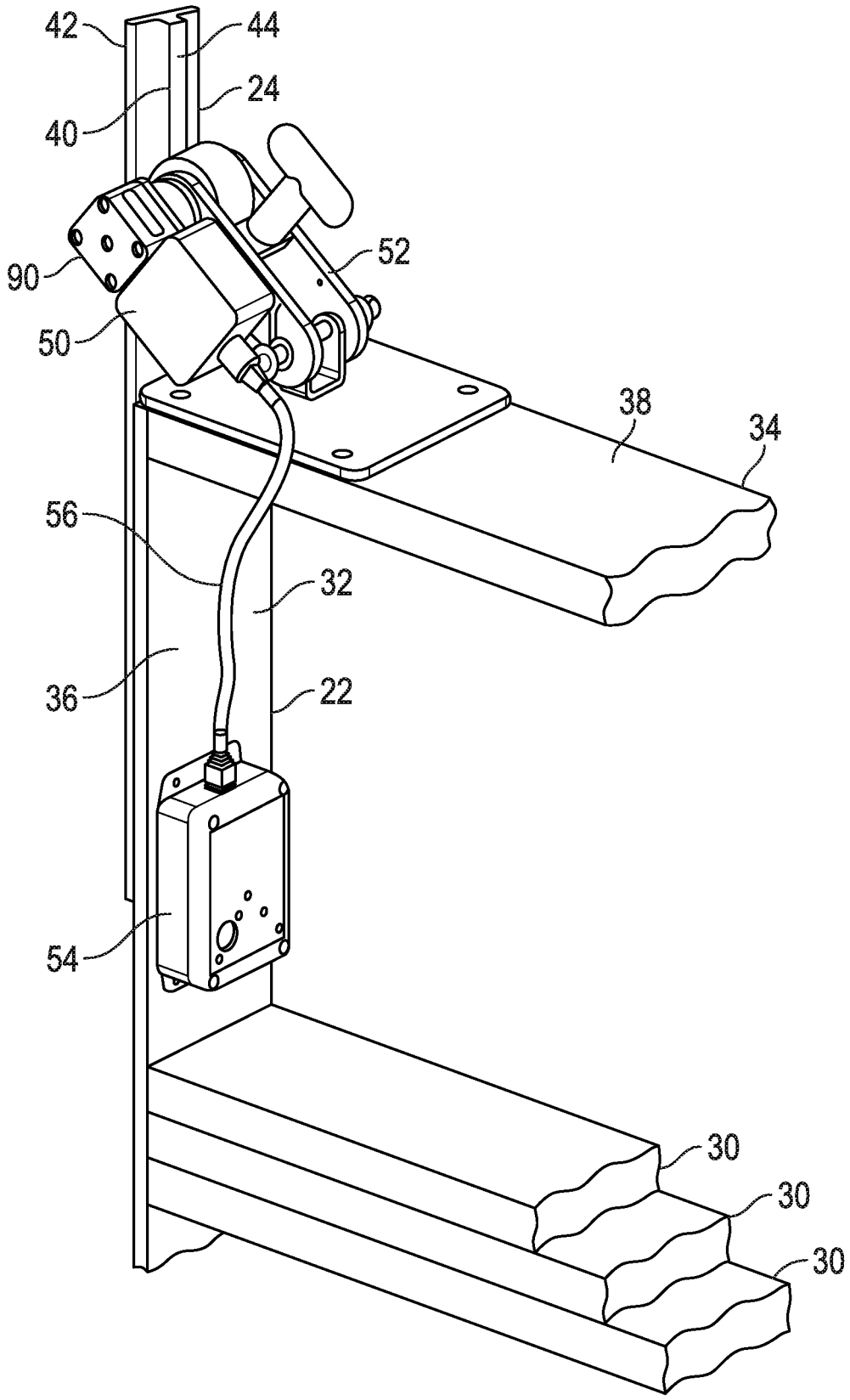
FIG. 4 is a perspective view of a portion of the counterweight of the conventional elevator of FIG. 1, illustrating the counterweight equipped with a counterweight signaling system.

Referring now to FIG. 4, a simplified, schematic illustration of a portion of the elevator counterweight assembly 22 and counterweight guide rail 24 are shown. The counterweight assembly 22 includes a plurality of filler weights 30 arranged in a stacked orientation and supported by opposing profiles 32 (for purposes of clarity, only one profile 32 is illustrated). The opposing profiles 32 are connected together at their upper ends by a cross member 34. The profiles 32 form inner major surfaces 36, extending in a substantially vertical orientation. The cross member 34 forms a substantially flat upper surface 38, extending from one profile 32 to the opposite profile 32.

Referring again to FIG. 4, the counterweight guide rail 24 has an inverted "T" cross-sectional shape and includes a flange 40 extending from a base 42. The flange 40 includes a front face 44. The counterweight guide rail 24 will be discussed in more detail below.

Referring again to FIG. 4, the counterweight assembly 22 has been equipped with a counterweight signaling system 50. The counterweight signaling system 50 is configured to provide visual and/or audio indications of a moving elevator counterweight assembly 22. The counterweight signaling system 50 includes an actuation assembly 52, a signaling assembly 54 and one or more electrical connectors 56 extending therebetween.

Figure 5:
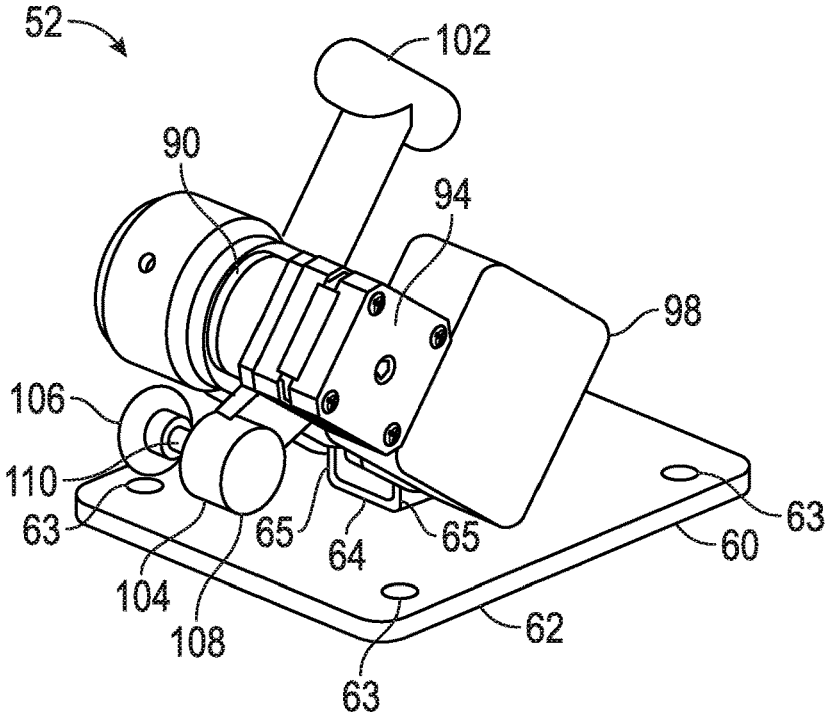
FIG. 5 is a front perspective view of an actuation assembly forming a portion of the counterweight signaling system of FIG. 4.
Figure 6:
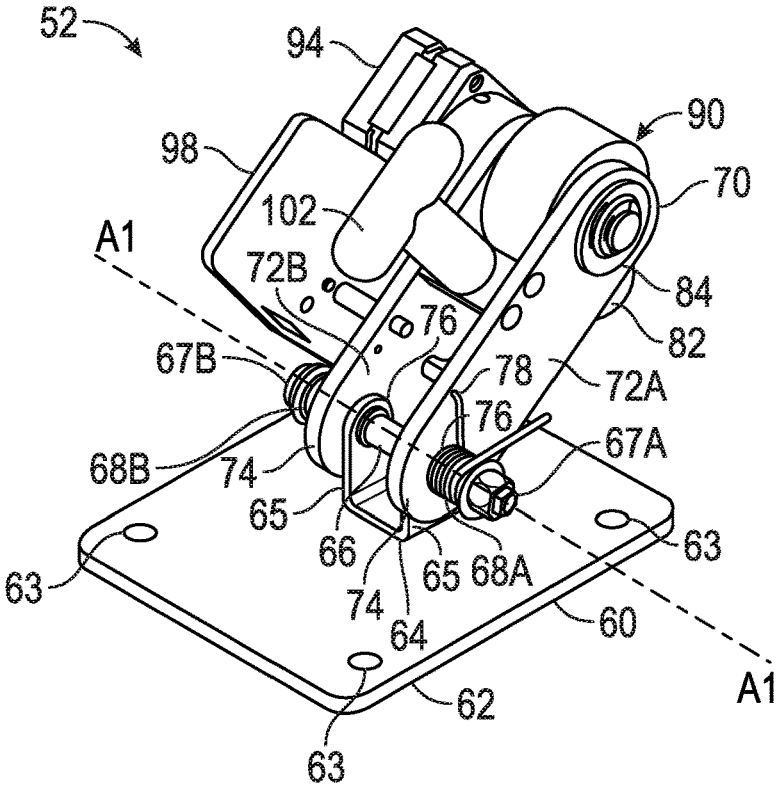
FIG. 6 is a rear perspective view of the actuation assembly of FIG. 5.
Figure 7:
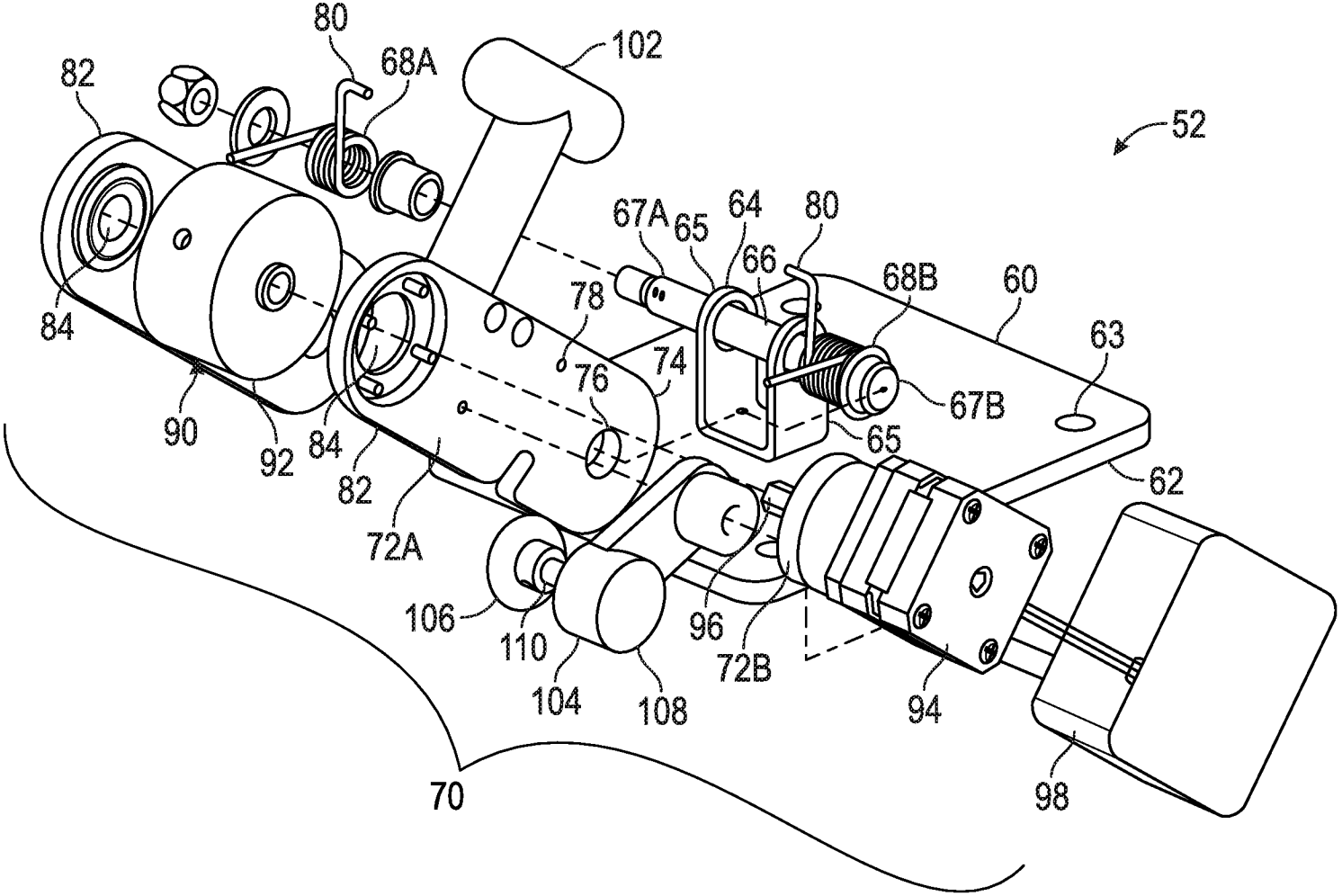
FIG. 7 is an exploded perspective view of the actuation assembly of FIG. 5.

Referring now to FIGS. 5-7, the actuation assembly 52 is illustrated. The actuation assembly 52 is configured for several functions. First, the actuation assembly 52 is configured to generate electrical power as the counterweight assembly 22 moves in a vertical direction along the counterweight guide rails 24. The generated electrical power is conveyed to the signaling assembly 54 by the one or more electrical connectors 56. The generated electrical power is used by the signaling assembly 54 to power visual and/or audio devices. Second, the actuation assembly 52 is configured to generate signals indicating movement by the counterweight assembly 22. The generated signals, indicating movement generated by the counterweight assembly 22 are discrete signals, separate and apart from the electrical power generated by the counterweight assembly 22.

Referring again to FIGS. 5-7, the actuation assembly 52 includes a base 60. The base 60 is configured for several functions. First, the base 60 has a lower major surface 62 and a plurality of apertures 63. The lower major surface 62 is substantially flat, thereby facilitating seating of the actuation assembly 52 on the upper surface 38 of the cross member 34 of the counterweight assembly 22. The apertures 63 are configured to align with corresponding apertures (not shown) in the cross member 34 of the counterweight assembly 22 and further configured to receive fasteners (not shown) for fastening of the actuation assembly 52 to the counterweight assembly 22.

Referring again to FIGS. 5-7, the base 60 is further configured to support a mount 64. The mount 64 includes opposing flanges 65 extending in a direction away from the base 60 and configured to support an axle 66. The axle 66 includes a first end 67A and a second end 67B. The ends 67A, 67B extend in an outboard arrangement from the flanges 65 of the mount 64 and are configured to receive spring members 68A, 68B respectively. The spring members 68A, 68B will be discussed in more detail below.

Referring again to FIGS. 5-7, a pivoting assembly 70 is rotatably supported by the axle 66 and includes opposing arms 72A, 72B. Each of the arms 72A, 72B has a first end 74 and a first aperture 76 therein. The first apertures 76 are configured for receiving the axle 66, such that the pivoting assembly 70 can rotate about an axle axis A1-A1.

Referring again to FIGS. 5-7, the first ends 74 of the arms 72A, 72B include a second aperture 78. The second apertures 78 are configured to receive formed portions 80 of the spring members 68. With the formed portions 80 seated in the second apertures 78, the spring members 68 are configured to urge the pivoting assembly 70 in a direction toward the front face 44 of the counterweight guide rails 24. Operation of the counterweight signaling system 50 will be discussed in more detail below.

Referring again to FIGS. 5-7, each of the arms 72A, 72B has a second end 82 and a third aperture 84 therein. The apertures 84 are configured to receive a portion of a dynamo assembly 90. The dynamo assembly 90 is configured to contact the face 44 of the counterweight guide rail 24 and further configured to generate electrical power as the counterweight assembly 22 moves along the counterweight guide rail 24. The dynamo assembly 90 includes a roller 92 coupled to a dynamo generator 94 by an axle 96 and a control circuitry module 98.

Referring again to FIGS. 5-7, the roller 92 is configured to contact and roll against the face 44 of the counterweight guide rail 24. In the illustrated embodiment, the roller 92 is formed of a material configured to facilitate rolling contact with the face 44 of the counterweight guide rail 24, such as the non-limiting examples of rubber-based or polyurethane-based materials. However, in other embodiments, the roller 92 can be formed from other desired materials, sufficient to facilitate rolling contact with the face 44 of the counterweight guide rail 24.

Referring again to FIGS. 5-7, the roller 92 and the dynamo generator 94 are coupled by the axle 96 such that rotation of the roller 92 actuates rotation of the dynamo generator 94, thereby generating electrical power. In the illustrated embodiment, the dynamo generator 94 is configured to generate electrical voltage in a range of from about 8.0 volts a.c. (alternating current) to about 30.0 volts a.c. and an electrical current in a range of from about 30.0 mA to about 50.0 mA at a rotational speed of about 1.0 revolution per second to about 3.0 revolutions per second. However, it should be appreciated that in other embodiments, the dynamo generator 94 can be configured to provide other voltages and currents at other rotational speeds. While the dynamo generator 94 is illustrated in FIGS. 5-7 as contained within an enclosure, it should be appreciated that in other embodiments, the enclosure is optional and the dynamo generator 94 need not be contained within an enclosure.

Referring again to FIGS. 5-7, the control circuitry module 98 is in electrical communication with the dynamo generator 94 and is configured to receive the electrical power generated by the dynamo generator 94. The control circuitry module 98 is further configured for several functions. First, the control circuitry module 98 is configured to rectify the alternating current generated by the dynamo generator 94 into direct current (d.c.). The d.c. electrical power provided by the dynamo generator 94 is conveyed to the signaling assembly 54 as will be discussed in more detail below. Second, the control circuitry module 98 is configured to regulate or limit the electrical power provided to the signaling assembly 54. In the illustrated embodiment, the control circuitry module 98 limits the electrical power provided to the signaling assembly 54 to 9.0 volts d.c. and 250.0 MA. However, in other embodiments, the control circuitry module 98 can limit the electrical power provided to the signaling assembly to other desired voltages and currents.

Referring again to FIGS. 5-7, a handle 102 is connected to the arms 72A, 72B at a position between the first and second apertures 76, 84. The handle 102 is configured to counter the force of the spring members 68A, 68B such that the pivoting assembly 70 can be urged in a direction away from the counterweight guide rail 24. Used in this manner, the handle 102 can facilitate alignment of the roller 92 with the face 44 of the counterweight guide rail 24. The handle 102 can have any desired shape and configuration sufficient to urge the pivoting assembly 70 is a direction away from the counterweight guide rail 24.

Referring again to FIGS. 5-7, a tachometer assembly 104 is connected to the pivoting assembly 70. The tachometer assembly 104 includes a drive wheel 106 mechanically coupled to a signal generator 108. The drive wheel 106 is configured to contact and roll against the face 44 of the counterweight guide rail 24. In the illustrated embodiment, the drive wheel 106 is formed of a material configured to facilitate rolling contact with the face 44 of the counterweight guide rail 24, such as the non-limiting examples of rubber-based or polyurethane-based materials.

Referring again to FIGS. 5-7, the drive wheel 106 and the signal generator 108 are coupled by an axle 110 such that rotation of the drive wheel 106 actuates rotation of the signal generator 108, thereby converting rotational movement of the drive wheel 106 into signals indicating linear movement of the counterweight assembly 22. Any desired tachometer assembly, sufficient to convert rotational movement of the drive wheel 106 into signals indicating linear movement of the counterweight assembly 22 can be used.

Referring now to FIG. 4, the electrical power generated by the dynamo assembly 90 and the movement signals generated by the tachometer assembly 104 are conveyed by the electrical connector 56 to the signaling assembly 54. In the illustrated embodiment, the electrical connector 56 is a multi-connector cable, such as for example a Category 5 cable, although other connectors, sufficient to convey the electrical power generated by the dynamo assembly 90 and the movement signals generated by the tachometer assembly 104 to the signaling assembly 54 can be used.

Figure 8:
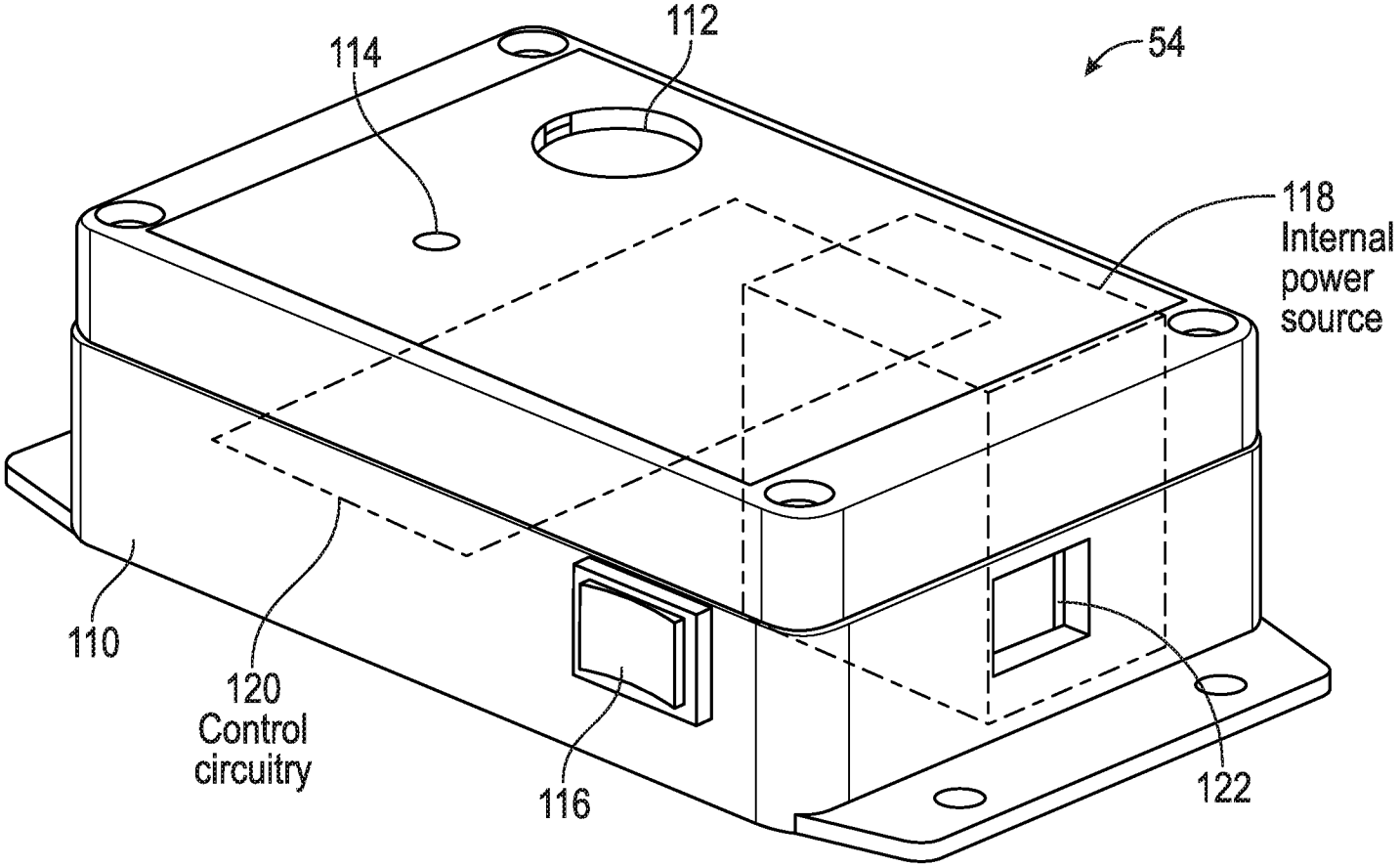
FIG. 8 is a perspective view of the signaling assembly of FIG. 4.

Referring now to FIG. 8, the signaling assembly 54 is illustrated. The signaling assembly 54 includes an enclosure 110 configured for mounting to the counterweight assembly 22. In the embodiment illustrated in FIG. 4, the signaling assembly 54 is mounted to the inner surface 36 of a profile 32 of the counterweight assembly 22. However, in other embodiments, the signaling assembly 54 can be mounted to other desired locations on the counterweight assembly 22. The enclosure 110 is further configured to house a visual indicator 112, an audio indicator 114, a switch 116, an optional internal power source (shown schematically at 118), control circuitry (shown schematically at 120) and one or more cable connectors 122.

Referring again to FIG. 8, the visual indicator 112 is configured to provide continuous visual indications as the counterweight assembly 22 moves within the elevator hoistway. In the illustrated embodiment, the visual indicator 112 is configured to provide a flashing strobe-style of light. However, in other embodiments, the visual indicator 112 can provide other forms of visual indications, such as the non-limiting examples of flashing colored lights and interrupted beams of light formed by one or more lasers. Any desired structure, mechanism or device can be used to provide the flashing strobe-style of light.

Referring again to FIG. 8, the audio indicator 114 is configured to provide continuous audio indications as the counterweight assembly 22 moves within the elevator hoistway. In the illustrated embodiment, the audio indicator 114 is configured to provide a beeping sound. The beeping sound can have any desired and suitable tone, pulse and volume. One non-limiting example of a suitable beeping sound is the sound provided by a 3 volt, piezo pulsing sounder at approximately 2.5 kHz, at 85.0 db. However, in other embodiments, the audio indicator 114 can provide other forms of audio indications, such as for example, sirens and the like. Any desired structure, mechanism or device can be used to provide the audio indications.

Referring again to FIG. 8, the switch 116 is configured to activate the signaling assembly 54. In the illustrated embodiment, the switch 116 is a conventional rocker-style on/off switch. However, other styles of switches, such as for example, toggle-style of switches, sufficient to activate the signaling assembly 54 can be used.

Referring again to FIG. 8, the signaling assembly 54 can be electrically powered from different electrical power sources. As one example, the signaling assembly 54 can be powered from electrical power sources external to the counterweight signaling system 50. In this scenario, electrical power can be provided to the counterweight assembly 22 via power lines from within the elevator hoistway 16. In other scenarios, the signaling assembly 54 can include an optional internal electrical power source 118. The internal power source 118 is configured to provide electrical power to the signaling assembly 54 in the event of a disruption in the electrical power provided to the signaling assembly 54, such as for example, a failure of the dynamo generator 94 or severing of the electrical connectors 56. In the illustrated embodiment, the internal power source 118 is a rechargeable battery such as the commercially available Tenergy NiMH model 10001, marketed by Tenergy Corporation, headquartered in Fremont, Calif. In certain instances, the internal power source 118 can be connected to the electrical connectors 56, such as to be recharged as necessary.

However, the internal power source 118 can have other forms and can be recharged by other methods.

Referring again to FIG. 8, the signaling assembly 54 includes the control circuitry 120. The control circuitry 120 is configured for several functions. First, the control circuitry 120 is configured to receive the electrical power generated by the dynamo generator 94 of the actuation assembly 52. Second, the control circuitry 120 is configured receive the movement signals generated by the tachometer assembly 104. Third, as the movement signals are received, the control circuitry 120 is configured to distribute the received electrical power to the visual and audio indicators 112, 114, thereby simultaneously activating the visual and audio indicators 112, 114.

Finally, the control circuitry 120 is configured to provide operation of the counterweight signaling system 50 for a plurality of fault conditions. Referring now to FIG. 9, fault conditions 130, 134, 138 and 142 are identified and correspond to fault operations 132, 136, 140 and 144 respectively. As a first example of a fault condition 130, the signaling assembly 54 is in an on mode and the signaling assembly 54 has electrical power, however the electrical connector 56 is disconnected or damage such that the electrical power generated by the dynamo generator 94 and the movement signals generated by the tachometer assembly 104 are not being received by the signaling assembly 54. In this fault condition, the control circuitry 120 operates as indicated by fault operation 132, that is, the visual and audio indicators 112, 114 remain activated with or without car movement.

As a second example of a fault condition 134, the signaling assembly 54 is receiving electrical power from the dynamo generator 94, however the signaling assembly 54 is not receiving movement signals generated by the tachometer assembly 104. In this fault condition, the control circuitry 120 operates as indicated by fault operation 136, that is, the visual and audio indicators 112, 114 remain activated with or without car movement.

As a third example of a fault condition 138, the signaling assembly 54 is receiving movement signals generated by the tachometer assembly 104, but not receiving electrical power from the dynamo generator 94. In this fault condition, the control circuitry 120 operates as indicated by fault operation 140, that is, the visual and audio indicators 112, 114 remain activated with or without car movement.

As a final example of a fault condition 142, the signaling assembly 54 detects a low electrical power condition of the internal power source 122 and is not receiving movement signals generated by the tachometer assembly 104. In this fault condition, the control circuitry 120 operates as indicated by fault operation 144, that is, the audio indicators 114 is activated as an indicator for low power.

Referring again to FIG. 8, the control circuitry 120 has the form of a printed circuit board. However, in other embodiments, the control circuitry 120 can have other desired forms sufficient for the functions described above.

Referring again to FIG. 8, the signaling assembly includes one or more cable connectors 122. The cable connectors 122 are configured to connect the electrical connectors 56 originating with the actuation assembly 52 with the control circuitry 120. In the illustrated embodiment, the cable connectors 122 are plug-in style of connectors. However, in other embodiments, the cable connectors 122 can have other forms, such as the non-limiting example of hard wired terminals.

Referring again to FIG. 4 and summarizing operation of the counterweight signaling system 50, the actuation assembly 52 is attached to the counterweight assembly 22 such that the roller 92 of the dynamo assembly 90 rides against the front face 44 of the counterweight guide rail 24. Tension of the roller 92 against the face 44 of the counterweight guide rail 24 results in rotation of the roller 92 as the counterweight assembly 22 moves vertically along the counterweight guide rails 24. As the roller 92 rotates, the roller 90 actuates the dynamo generator 94 such as to generate electrical power.

Referring again to FIG. 4, as the counterweight assembly 22 moves vertically along the counterweight guide rails 24, the drive wheel 106 of the tachometer assembly 104 contacts and rolls against the face 44 of the counterweight guide rail 24, thereby actuating the signal generator 108 to generate signals indicating linear movement of the counterweight assembly 22.

Referring again to FIG. 4, as the counterweight assembly 22 moves vertically along the counterweight guide rails 24, the electrical power generated by the dynamo generator 94 and the movement signals generated by the tachometer assembly 104 are conveyed by the electrical connection 56 and received by the signaling assembly 54.

While the embodiment of the counterweight signaling system 50 described above and illustrated in FIGS. 1-6 shows the attachment of the actuation assembly 52 on an upper surface of the counterweight assembly 22, it should be appreciated that the actuation assembly 52 can be attached to the counterweight assembly 22 at any location sufficient to allow the roller 92 and the drive wheel 106 to track on a face of the counterweight guide rail 24. Further, it should be appreciated that the actuation assembly 52 can be attached to the counterweight assembly 22 in any desired manner, including the non-limiting methods of using fastening hardware and/or magnetic clamps.

While the embodiment of the counterweight signaling system 50 described above and illustrated in FIG. 4 shows the attachment of the signaling assembly 54 on a inner surface of the counterweight assembly 22, it should be appreciated that the signaling assembly 54 can be attached to the counterweight assembly 22 at any location sufficient to provide visual and/or audio notice of a moving elevator counterweight.

While the embodiment of the counterweight signaling system 50 described above and illustrated in FIGS. 1-8 shows the application of the counterweight signaling system 50 to the counterweight assembly 22, it is within the contemplation of the invention that the counterweight signaling system 50 can be applied to other structures configured to move within the building hoistway, such as the non-limiting examples of construction platforms, car slings and/or moving skips. In this manner, the counterweight signaling system 50 can be configured to provide notice to others located in or about the hoistway of any moving structure.

The embodiment of the counterweight signaling system 50 described above and illustrated in FIGS. 1-8 makes use of a roller 92 and the drive wheel 106 in rolling contact with a counterweight guide rail 24. It should be evident that the counterweight guide rail 24 provides sufficient rigidity that the roller 92 and the drive wheel 106 can be pressed against to the counterweight guide rail 24 with sufficient pressure to actuate the dynamo generator 94 and the signal generator 108. However, it is further contemplated that the counterweight signaling system 50 could be used in applications that do not utilize a counterweight guide rail. As one non-limiting example, it is contemplated that the counterweight signaling system 50 could be adapted such that the roller 92 and the drive wheel 106 are in rolling contact with a wall, building members or other structures providing sufficient rigidity to enable the roller 92 and the drive wheel 106 to actuate the dynamo generator 94 and the drive wheel 106. Such adaption of the counterweight signaling system 50 would enable application to other embodiments using vertically moving structures, such as, for example window washing platforms, vertically movable scaffolding, traveling ladders and the like.

The principle and mode of operation of the elevator counterweight signaling system have been described in the illustrated embodiments. However, it should be noted that the elevator counterweight signaling system may be practiced otherwise than as specifically illustrated and described without departing from its scope.

What is claimed is:

1. An elevator counterweight signaling system comprising:

an actuation assembly configured for contact with an elevator counterweight guide rail, the actuation assembly having a dynamo assembly, a roller, a tachometer assembly, a drive wheel, a signal generator and a pivoting assembly;

a signaling assembly configured for electrical communication with the actuation assembly, the signaling assembly having a visual indicator, an audio indicator, control circuitry and a cable connector; and one or more electrical connectors configured to electrically connect the actuation assembly with the signaling assembly;

wherein the signaling assembly is configured to provide visual and/or audio indications of a moving elevator counterweight assembly.

2. The elevator counterweight signaling system of claim 1, wherein the elevator counterweight signaling system is mounted to a counterweight.

3. The elevator counterweight signaling system of claim 1, wherein the roller of the actuation assembly is configured for contact with the elevator counterweight guide rail.

4. The elevator counterweight signaling system of claim 3, wherein the pivoting assembly is configured to rotate the roller into contact with the elevator counterweight guide rail.

5. The elevator counterweight signaling system of claim 3, wherein the roller is coupled to a dynamo generator such that rotation of the roller provides rotation of the dynamo generator.

6. The elevator counterweight signaling system of claim 5, wherein rotation of the dynamo generator is configured to provide electrical power to the signaling assembly.

7. The elevator counterweight signaling system of claim 1, wherein the drive wheel of the actuation assembly is configured for contact with the elevator counterweight guide rail.

8. The elevator counterweight signaling system of claim 7, wherein the drive wheel is connected to a pivoting assembly and wherein the pivoting assembly is configured to rotate the drive wheel into contact with the elevator counterweight guide rail.

9. The elevator counterweight signaling system of claim 7, wherein the drive wheel is coupled to the signal generator such that rotation of the drive wheel results in rotation of the signal generator.

10. The elevator counterweight signaling system of claim 9, wherein rotation of the signal generator provides signals indicating movement of the counterweight assembly.

11. The elevator counterweight signaling system of claim 1, wherein the visual indicator of the signaling assembly includes a flashing strobe light.

12. The elevator counterweight signaling system of claim 1, wherein the audio indicator of the signaling assembly provides a beeping sound.

13. The elevator counterweight signaling system of claim 1, wherein the dynamo assembly of the actuation assembly is configured to provide electrical power to the signaling assembly.

14. The elevator counterweight signaling system of claim 1, wherein the tachometer assembly of the actuation assembly is configured to provide signals to the signaling assembly indicating movement of the counterweight assembly.

15. The elevator counterweight signaling system of claim 1, wherein the control circuitry of the signaling assembly is powered by an internal power source.

16. The elevator counterweight signaling system of claim 4, wherein the pivoting assembly is rotatably supported by opposing arms.

17. The elevator counterweight signaling system of claim 1, wherein the control circuitry of the signaling assembly is configured to receive electrical power and movement signals from the actuation assembly.

18. The elevator counterweight signaling system of claim 1, wherein the pivoting assembly of the actuation assembly includes one or more spring members configured to urge the pivoting assembly against the elevator counterweight guide rail.

19. The elevator counterweight signaling system of claim 1, wherein operation of the signaling assembly is configured to change for a given fault condition.

20. The elevator counterweight signaling system of claim 19, wherein the visual and audio indicators of the signaling assembly remain activated in an event electrical power to the signaling assembly is disconnected and/or in an event movement signals to the signaling assembly are disconnected.

* * * * *